US007416631B2

(12) United States Patent
Pasternicki

(10) Patent No.: US 7,416,631 B2
(45) Date of Patent: Aug. 26, 2008

(54) METHOD AND DEVICE FOR ASSEMBLING A BLISTER SHEET AND A LINERBOARD

(75) Inventor: Michel Pasternicki, Saint-Arnoult (FR)

(73) Assignee: Paker, Gellainville (FR)

( * ) Notice: Subject to any disclaimer, the term of this patent is extended or adjusted under 35 U.S.C. 154(b) by 486 days.

(21) Appl. No.: 10/508,823

(22) PCT Filed: Mar. 25, 2003

(86) PCT No.: PCT/FR03/00935

§ 371 (c)(1),
(2), (4) Date: Oct. 20, 2004

(87) PCT Pub. No.: WO03/080442

PCT Pub. Date: Oct. 2, 2003

(65) Prior Publication Data

US 2005/0145332 A1 Jul. 7, 2005

(30) Foreign Application Priority Data

Mar. 25, 2002 (FR) ..... 02 03682
Apr. 8, 2002 (FR) ..... 02 04314

(51) Int. Cl.
*B32B 37/00* (2006.01)
*B29C 65/00* (2006.01)

(52) U.S. Cl. ..... 156/308.2; 156/293; 156/309.6; 53/454

(58) Field of Classification Search ..... 156/293, 156/308.2, 309.6; 53/454, 157, 560
See application file for complete search history.

(56) References Cited

U.S. PATENT DOCUMENTS 4,506,495 A * 3/1985 Romagnoli ..... 53/559
5,081,816 A * 1/1992 Cardinali ..... 53/54
5,542,235 A 8/1996 Konstandin

FOREIGN PATENT DOCUMENTS

CH 281306 2/1952
DE 20105928 U1 * 6/2001
FR 1343517 11/1963

OTHER PUBLICATIONS

Abstract for DE20105928 Jun. 2001.*

* cited by examiner

*Primary Examiner*—John L Goff
(74) *Attorney, Agent, or Firm*—Levine & Mandelbaum

(57) ABSTRACT

A method and a machine for assembling a blister sheet and a linerboard, the board optionally having a flap. The blister sheet, the linerboard and the optional flap are flat stacked on top of one another; and the layers are subsequently heat sealed, preferably by means of thermal conduction or induction between a counter electrode and an electrode, continuously and in respective closed circuits, in order to produce cases for packaging such items as medicaments, electronic components, small tools, perfume samples or any other product which is to be enclosed in at least one bubble of the blister sheet.

27 Claims, 8 Drawing Sheets

METHOD AND DEVICE FOR ASSEMBLING A BLISTER SHEET AND A LINERBOARD

BACKGROUND OF THE INVENTION

The present invention relates to a method of assembly between:

a blister sheet having two plane main faces and comprising at least one product containment blister projecting on a first of said main faces, and a linerboard having two plane main faces and comprising at least one hole for the passage of said blister, the blister sheet and the linerboard being capable of occupying a defined relative position, in which a first of said main faces of the linerboard is laid against the first main face of the blister sheet, around the blister, and at least one of the first main faces being thermoadhesive or being made thermoadhesive, said method comprising the succession of steps involving:

a) placing the blister sheet and the linerboard in said defined relative position, b) applying to the blister sheet and to the linerboard, which occupy said defined relative position, a pressure for the mutual clamping of their first main faces and a treatment capable of making adhesive said first main face which is thermoadhesive or is made thermoadhesive, for the time necessary for bringing about a mutual thermoadhesion of said first main faces, c) causing the application of said pressure and said treatment to cease.

Such a method is used, for example, in the pharmaceutical industry, in order to assemble a blister sheet generally comprising a plurality of blisters containing a respective dose of a drug, for example in the form of a tablet or of a capsule, together with a linerboard carrying particulars identifying the drug and, for example, particulars relating to its dosage or particulars making it easier to adhere to this dosage. Said method may also have applications in very different technical fields, such as the packaging of perfume samples, of electronic components or of small tools, these examples in no way being limiting.

In the present prior art, this method is employed:

either manually, that is to say, more specifically, by handlers who superpose the blister sheet and the linerboard in said defined relative position by hand, if appropriate turn down flat onto the second of the main faces of the blister sheet a flap initially placed in the extension of the linerboard, in order to carry out step a, then manually offer the assembly thus formed between the plates of a thermoadhesion press, manually command the application of pressing, generally for a predetermined time, thereby carrying out steps b and c, and then manually recover the assembly thus assembled after the opening of the press, or automatically, corresponding, in fact, to an automation of the steps of the manual method which has just been described, especially with regard to the offer to the thermoadhesion press and the recovery after thermoadhesion which continue to employ an alternating movement.

This alternating movement of offer to the press and of recovery in the latter, even if it is carried out automatically, does not make it possible to achieve assembly rates as high as the possible rates for the production of the blister sheets and for the subsequent packaging of the assemblies respectively formed by a blister sheet and a linerboard mutually assembled, with the result that the operation of mutually assembling the linerboards, as it is currently carried out, slows the entire line for the packaging of a product from the placing under the blister sheet in the final packaging of the assemblies consisting of the blister sheets and of the linerboards mutually assembled.

SUMMARY OF THE INVENTION

The object of the present invention is to overcome this disadvantage, and, for this purpose, the present invention proposes to carry out steps b and c of the abovementioned assembly method by causing a succession of individualized blister sheets and of linerboards, placed in said defined relative position during step a, to travel jointly and continuously, said step a likewise being carried out continuously, which may be considered as being known in principle owing to the existence of machines carrying out the abovementioned automatic method of the prior art.

The present invention proposes, furthermore, a machine which, comprising means for carrying out the succession of steps a, b and c, is characterized in that the means for carrying out steps b and c comprise means for causing a succession of individualized blister sheets and of linerboards, placed in their defined relative position during step a, to travel jointly and continuously, said step a itself being carried out by means working continuously, in a way known in principle.

A person skilled in the art will easily understand that such a continuous carrying out of steps b and c, after a continuous carrying out of step a, makes it possible to achieve rates of mutual assembly of the blister sheets and linerboards in correlation with the possible rates for the prior production of the blister sheets and for the subsequent packaging of the assemblies formed by the blister sheets and the linerboards in the mutually assembled state, thus making it possible considerably to increase the rates of the lines carrying out in succession the production of the blister sheets, that is to say the containment of the products to be packaged in the latter, the mutual assembly of the blister sheets and of the linerboards and the packaging of the blister sheets and of the linerboards thus mutually assembled.

If, as is known, the linerboard comprises a flap having a first main face initially placed in the extension of the first main face of the linerboard and, in said defined relative position, occupying a turned-down position in which its said first main face is laid against the second of said main faces of the blister sheet, at least the first main face of the flap or the second main face of the blister sheet being thermoadhesive or being made thermoadhesive, preferably the flap is placed in said turned-down position, during step a, after the first main faces of the linerboard and of the blister sheet have been laid against one another, and step b is carried out when the flap occupies said turned-down position, in such a way that said mutual clamping pressure likewise forms a pressure for the mutual clamping of the first main face of the flap and of the second main face of the blister sheet, and in such a way that said treatment likewise makes adhesive said main face of these main faces which is thermoadhesive or is made thermoadhesive, said time being selected in such a way that it is sufficient likewise in order to bring about a mutual thermoadhesion of the first main face of the flap and of the second main face of the blister sheet.

For this purpose, the machine according to the invention preferably comprises means for placing the flap in said turned-down position during step a, after the first main faces of the linerboard and of the blister sheet have been laid against one another, and the means for carrying out step b are capable of carrying out this step b when the flap occupies said turned-down position, in such a way that said mutual clamping pressure also forms a pressure for the mutual clamping of the first main face of the flap and of the second main face of the blister sheet, and in such a way that said treatment likewise makes adhesive said main face of these main faces which is thermoadhesive or is made thermoadhesive, said time being selected in such a way that it is sufficient likewise in order to bring about a mutual thermoadhesion of the first main face of the flap and of the second main face of the blister sheet.

So that adherence to the time necessary for causing a mutual thermoadhesion of the first main faces of the blister sheet and of the linerboard and, where appropriate, a thermoadhesion of the first main face of the flap to the second main face of the blister sheet does not give rise to an excessive overall size of the machine according to the invention, the blister sheets and the linerboards are preferably caused to travel along a curved path during step b.

Moreover, this step b may be carried out by any type of known means for applying said mutual clamping pressure and said treatment capable of making adhesive the face or faces which are thermoadhesive or are made thermoadhesive.

It is thus possible, for example, to perform the thermoadhesion by ultrasonic applications or else by induction or by thermal conduction or else by any other suitable means.

However, it is preferable to use means of thermoadhesion by induction or means of thermoadhesion by thermal conduction which preserve the property of a barrier to air and to moisture possessed, in particular, by PVC and ACLAR, the materials often used to form the transparent part of a blister sheet, especially in the pharmaceutical industry.

Thus, according to a preferred embodiment of the method according to the invention, a plurality of electrodes and a plurality of counterelectrodes are circulated continuously in a respective closed circuit, said closed circuits comprising a common limited portion, along which the electrodes and counterelectrodes follow a common path, at the same time being matched in a defined relative position in which they offer a respective plane face toward one another, between an entrance, at which the electrodes and counterelectrodes approach one another, at the same time circulating along said respective closed circuit, and an exit, at which the electrodes and counterelectrodes move apart from one another, at the same time circulating along said respective closed circuit, and step b is carried out by introducing a blister sheet and a linerboard, placed in their said defined relative position during step a, between a mutually corresponding electrode and counterelectrode at the entrance of said common path, and by causing the blister sheet and the linerboard, placed in their said defined relative position, to execute said common path between said mutually corresponding electrode and counterelectrode, as far as the exit, at which the mutual spacing apart of said mutually corresponding electrode and counterelectrode carries out step c.

When the comparative dimensions of the linerboard, between its two main faces, and of the projection which the blister forms on the first main face of the blister sheet are such that the blister likewise forms a projection with respect to the second main face of the linerboard in said defined relative position, there is provision for one of the plane faces which the electrode and counterelectrode offer toward one another when they follow said common path to have at least one cell for receiving a blister, and step b is carried out so as to engage the blister in said cell.

In other words, in the machine according to the invention, the thermoadhesion means comprise, in this preferred embodiment of the method according to the invention, means for continuously circulating said plurality of electrodes and said plurality of counterelectrodes in said respective closed circuit, and this machine comprises means for introducing a blister sheet and a linerboard, which are placed in their said defined relative position, between a mutually corresponding electrode and counterelectrode at the entrance of said common path, if appropriate so as to engage the blister in said cell, and means for releasing the mutually assembled blister sheet and linerboard from between said electrode and said counterelectrode at the exit of said common path.

The term "electrode" is understood here to mean an active member in the generation of the heating necessary for thermoadhesion, and the term "counter-electrode" is understood here to mean a member forming a simple counterpart which is passive in this regard, both and/or either of these members being capable of being active in applying the pressure, which, moreover, is necessary for this thermoadhesion. Thus, within the meaning of the present invention, the electrode may consist of a press plate which incorporates at least one ultrasonic transmitter or at least one inductor or at least one electrical heating resistor, depending on the type of thermoadhesion means which is selected, and, within the meaning of the present invention, the counterelectrode may consist of a press plate simply produced from one or more materials selected so as to cause it to be a compatible counterpart to the electrode.

Since the counterelectrodes are simpler in technical terms than the electrodes and less costly, they may be provided in a larger number than the number of electrodes and they may be caused to execute a more complex closed circuit, without this resulting in a prohibitive extra cost of the machine for carrying out the method, as compared with the advantages which may be expected from it.

Thus, according to a preferred embodiment of the method according to the invention, the counterelectrodes are caused to execute, upstream of said common path, an upstream path along which their said face faces upward, and they are used, along this upstream path, as vehicles for a respective blister sheet and linerboard during the carrying out of step a.

For this purpose, advantageously, the counterelectrodes are produced or selected in such a way that they have respectively said contingent cell, and step a is carried out by successively depositing, flat, by suitable means of the machine according to the invention in a preferred embodiment of the latter:

the linerboard with the second of its said main faces on said face of a counterelectrode, said hole being placed in register with said cell, and the blister sheet with its first main face on the first main face of the linerboard, said blister being engaged in said hole and, through the latter, in said cell.

Subsequently, if appropriate, that is to say if the linerboard comprises a flap, as mentioned above, the carrying out of step a is continued by folding the contingent flap of the linerboard by suitable means of the machine in order to bring said flap from its initial position into its turned-down position.

It will be seen that, owing to the presence of the contingent cell receiving the blister, the counterelectrodes form an especially effective means of ensuring an exact mutual indexing of the linerboards, of the blister sheets and of the counterelectrodes before the path common to the electrodes is executed.

Likewise, the counterelectrodes are preferably caused to execute, downstream of said common path, a downstream path which is an integral part of their closed circuit and along which their said face faces upward, in which case they are used, along this downstream path, as vehicles for a respective mutually assembled blister sheet and linerboard.

The counterelectrodes may, of course, likewise be used thus, upstream and/or downstream of the common path, as vehicles for the linerboards and for the blister sheets in the absence of a cell in the plane face of the counterelectrodes. In the case of such an absence, the mutual indexing of the linerboards, of the blister sheets and of the counterelectrodes may be ensured by auxiliary means, such as at least one positioning dog integral with each counterelectrode respectively.

By contrast, in order to cause the common path of electrodes and of the counterelectrodes to be curved, preferably the closed circuit of the electrodes is circular and the closed circuit of the counterelectrodes is in the form of an arc of a circle coaxial to the closed circuit of the electrodes along said common path.

Thus, according to a preferred embodiment of the machine according to the invention, the means for circulating the electrodes in a closed circuit comprise a wheel mounted rotatably about a defined axis and carrying the electrodes, by means allowing a centripetal elastic retraction of the latter independently of one another, in an orientation in which said face of each faces in the centrifugal direction, and a motor for driving the wheel in a defined direction such that said common path is covered from the entrance toward the exit, and the means for circulating the counterelectrodes in a closed circuit comprise an endless conveyor guided in an arc of a circle coaxial to said wheel about the latter and carrying the counterelectrodes in an orientation such that said face of each faces toward said face of a respective electrode along said arc of a circle, and means for intermeshing between said wheel and said endless conveyor, in such a way that the motor for driving the wheel likewise drives the endless conveyor by means of the wheel and in synchronism with the latter.

A person skilled in the art will easily understand that there is thus obtained an especially simple embodiment of the means making it possible to cause the electrodes to execute a circular closed circuit and at the same time to ensure a perfect synchronism of respective displacements of the electrodes and the counterelectrodes along their respective closed circuit. A setting of the means provided for elastically opposing the centripetal retraction of the electrodes makes it possible to ensure a setting of the pressure which is applied between these and the counterelectrodes to the blister sheets and to the linerboards occupying their predetermined relative position during the carrying out of step b.

Furthermore, means may advantageously be provided for bringing about a coercive centripetal retraction of the electrodes in the event of a stoppage of the drive motor, thus making it possible to avoid maintaining the pressure and heating for too long a time during the carrying out of step b and consequently to avoid bringing about a fusion of the component material of the blister sheet and, where appropriate, of the component material of the linerboard, which may be accompanied by adhesion to the electrodes or counterelectrodes; it is nevertheless prudent however, to eliminate the blister sheets and linerboards which are executing the common thermoadhesion path during such a stoppage of the drive motor.

Preferably, to prevent the blister sheets and linerboards from tending to accompany the movement of the electrodes rather than that of the counterelectrodes, once they have crossed their common thermoadhesion path, when the counterelectrodes form vehicles for a respective mutually assembled blister sheet and linerboard, downstream of said common path, each electrode preferably has at least one respective ejection pusher elastically retractable from a defined position in which it projects on said face of the respective electrode. This ejection pusher is retracted at the entrance of the common path under the effect of its application to said face of the counterelectrode by means of the mutually superposed blister sheet and linerboard, and thus remains retracted during the entire coverage of the common path; by contrast, at the exit of the latter, from the moment when the counterelectrode no longer maintains said ejection pusher elastically in a retracted state by means of the respective blister sheet and linerboard, said ejection pusher tends to resume said defined position projecting with respect to the face of the electrode and, thus returning to its said defined position, it pushes back the blister sheet and linerboard in the mutually assembled state and forces them to remain on said face of the counterelectrode.

It will be seen that a machine according to the invention has a high simplicity in terms of implementation, thus resulting especially in high reliability in spite of the considerably increased rates, as compared with the prior art, the carrying out of the method according to the invention making it possible to have access to such rates.

Other characteristics and advantages of the method and of the machine according to the invention will become apparent from the following description relating to a respective non-limiting exemplary embodiment and from the accompanying drawings which are an integral part of this description.

DESCRIPTION OF THE PREFERRED EMBODIMENT

Figure 2:
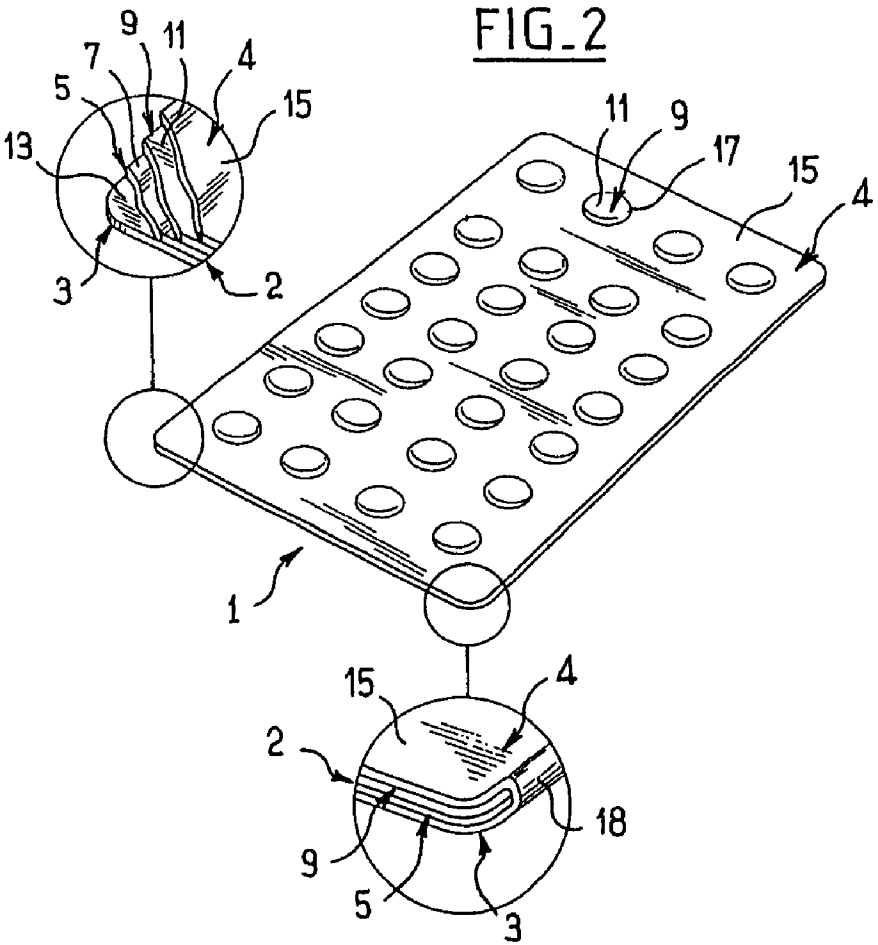
FIGS. 1 and 2 show respective recto and verso perspective views of the assembly consisting of a blister sheet and of a linerboard with flap, which are assembled by means of the method according to the invention, with an illustration on a larger scale of two details, one of which is partially cut away.
Figure 1:
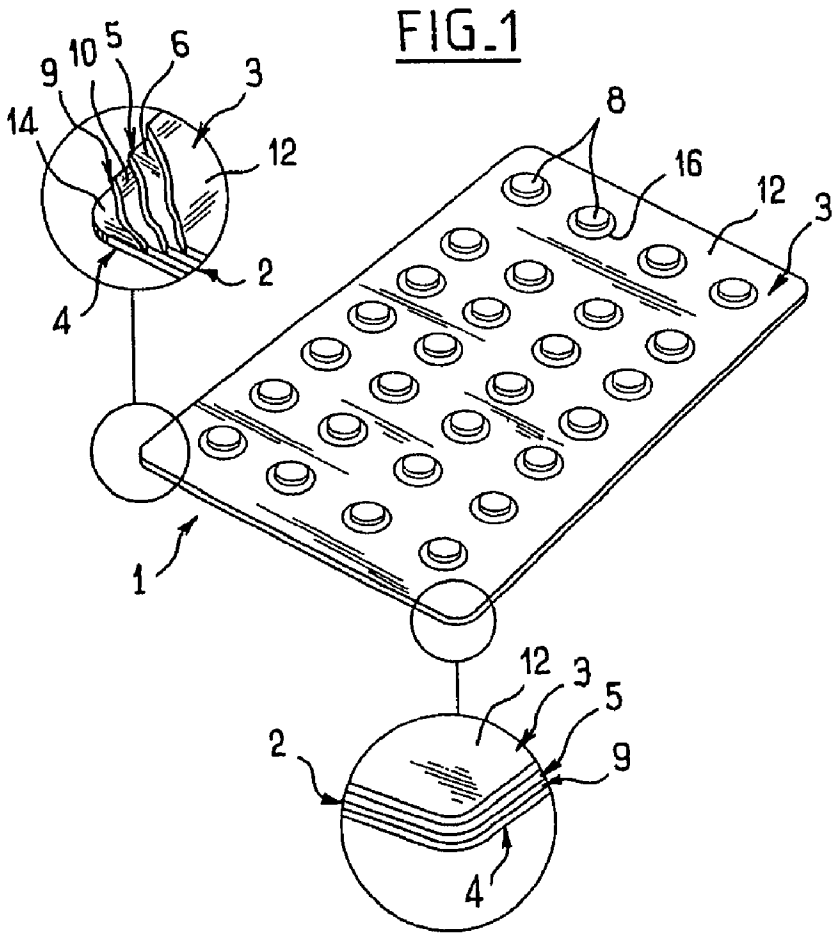

Reference will be made in the first place to FIGS. 1 and 2 which illustrate an assembly 1, generally designated by the term "wallet" and produced by the integral assembling, by means of the method according to the invention indicated diagrammatically in FIG. 3, of two initially separate components, to be precise a blister sheet 2 and a linerboard 3 which, in the example illustrated, has a flap 4 produced in one piece with it; however, this flap 4 is optional with regard to carrying out the present invention, and a person skilled in the art will easily understand that the steps of the method according to the invention which will be described hereafter and which are associated with the presence of this flap 4 would simply be omitted in the absence of such a flap 4.

The blister sheet 2 generally consists itself of two components integrally assembled by thermoadhesion prior to the carrying out of the method according to the invention, to be precise:

a sheet 5 of a transparent semirigid thermoplastic material, having two mutually parallel plane main faces 6, 7 and thermoformed so as to have, projecting on its main face 6, that is to say recessed in its main face 7, at least one blister 8, to be precise, in the nonlimiting example illustrated, 28 mutually identical and uniformly distributed blisters 8, this blister 8 or each of these blisters 8 respectively containing, as a nonlimiting example, a tablet or a capsule, not illustrated and not designated, and a flexible sheet 9 generally formed from a multilayer material comprising, in particular, an aluminum layer having two main faces 10, 11, the first of which is integrally secured flat, in a leaktight manner, for example by thermoadhesion, to the face 7 which it covers, including in the region of the blisters 8, in order to close the latter in a leaktight manner on all sides, the sheet 9 being selected so as to be tearable at will by a user, for example under the effect of a pressure applied to a blister 8 and transmitting to the sheet 9 by means of the product contained in this blister 8.

The two sheets 5 and 9, that is to say likewise their main faces 6, 7, 10, 11, have the same rectangular plane in the example illustrated.

Such a design of the blister sheet 2 is well known to a person skilled in the art, and the present invention applies just as well to blister sheets of different design, likewise known, comprising, like the blister sheet 2 illustrated, two plane main faces, to be precise, in the example illustrated, the faces 6 and 11 opposite to the mutual assembly faces 10 and 7 of the sheets 5 and 9, one of these main faces, to be precise, to this example, the face 6, carrying in relief at least one blister 8 receiving whatever product, whatever the type of component materials of these blister sheets.

The linerboard 3 is itself produced, in one piece with its contingent flap 4, from a semirigid material, such as cardboard or a thermoplastic. It has two mutually parallel plane main faces 12, 13. Likewise, the flap 4 has two mutually parallel main faces 14, 15 which extend the face 13 and the face 12 in a coplanar manner in an initial state of the flap 4 with respect to the linerboard 3, that is to say in a state prior to the carrying out of the present invention.

The linerboard 3 and the flap 4, that is to say their main faces 12, 13, 14, 15, have a form identical to that of the main faces 6 and 11 of the blister sheet 2, that is to say a rectangular form in the example illustrated, with dimensions identical to or slightly greater than those of these faces 6 and 11.

In positions which, respectively on the face 12 of the linerboard 3 and on the face 14 of the flap 4, correspond to the respective positions of the blisters 8 on the face 6 of the blister sheet 2, the linerboard 3 and the flap 4 are pierced right through with respective holes 16, 17 which have a form similar to that which a blister 8 has at its connection to the face 6, but a slightly greater dimension, in such a way that, as shown in FIGS. 1 and 2, the linerboard 3 can be laid flat, with its face 13, against the face 6 of the blister sheet 2, with each blister 8 being engaged in a respective hole 16, and the flap 4 can be laid flat, with its face 14, against the face 11 of the blister sheet 2, with a hole 16 being placed opposite each blister 8, in order to make it easier to extract the contents of this blister 8 by perforating the sheet 9.

The flap 4 and the linerboard 3 are connected to one another along a straight folding line 18, illustrated in FIG. 2 as a material bridge connecting them to one another, this folding line 18 coinciding with a respective one of their longest edges.

At least one of the faces 11 and 14 and at least one of the faces 6 and 13 is naturally thermoadhesive or is made thermoadhesive by means of a suitable method known to a person skilled in the art, such as a polyethylene coating, and the method according to the invention is used, in the application illustrated, for the thermoadhesion of the face 13 of the linerboard 3 to the face 6 of the blister sheet 2, all around the holes 16 and the blisters 8, and of the face 14 and the contingent flap 4 to the face 11 of the blister sheet 2, all around the holes 17 and, if appropriate, of the faces 13 of the linerboard and 14 of the contingent flap 4, around the blister sheet 2, in order to form the wallet 1 from the blister sheet 2 already produced, on the one hand, and from the linerboard 3 and the flap 4 occupying their initial relative position, on the other hand.

Figure 3:
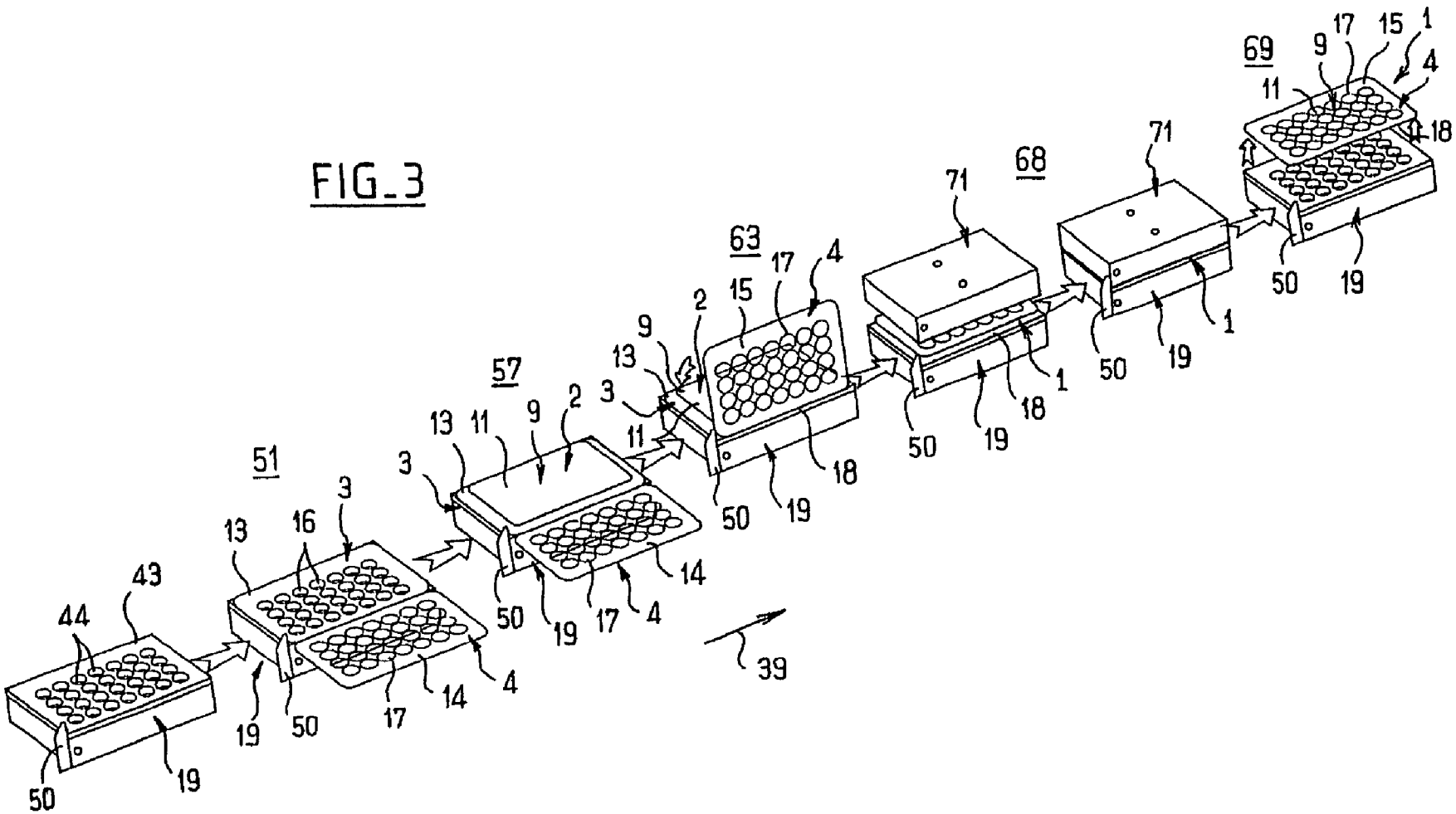
FIG. 3 illustrates the main successive steps of the method according to the invention which are used for producing the assembly illustrated in FIGS. 1 and 2 from a linerboard with flap and from a blister sheet.

For this purpose, as indicated diagrammatically in FIG. 3, and using a machine 20, a currently preferred embodiment of the invention of which is illustrated in FIGS. 4 to 12, use is made of a method of thermoadhesion by induction or, also preferably, by Joule effect and thermal conduction, applied to linerboards 3, with their contingent flap 4, and to blister sheets 2 travelling continuously, being transported for this purpose by vehicles advantageously consisting of suitable thermoadhesion counterelectrodes 19 which are circulated in a closed circuit and continuously, that is to say always in the same direction and at a constant speed after setting, under the normal operating conditions of the machine 20.

Figure 4:
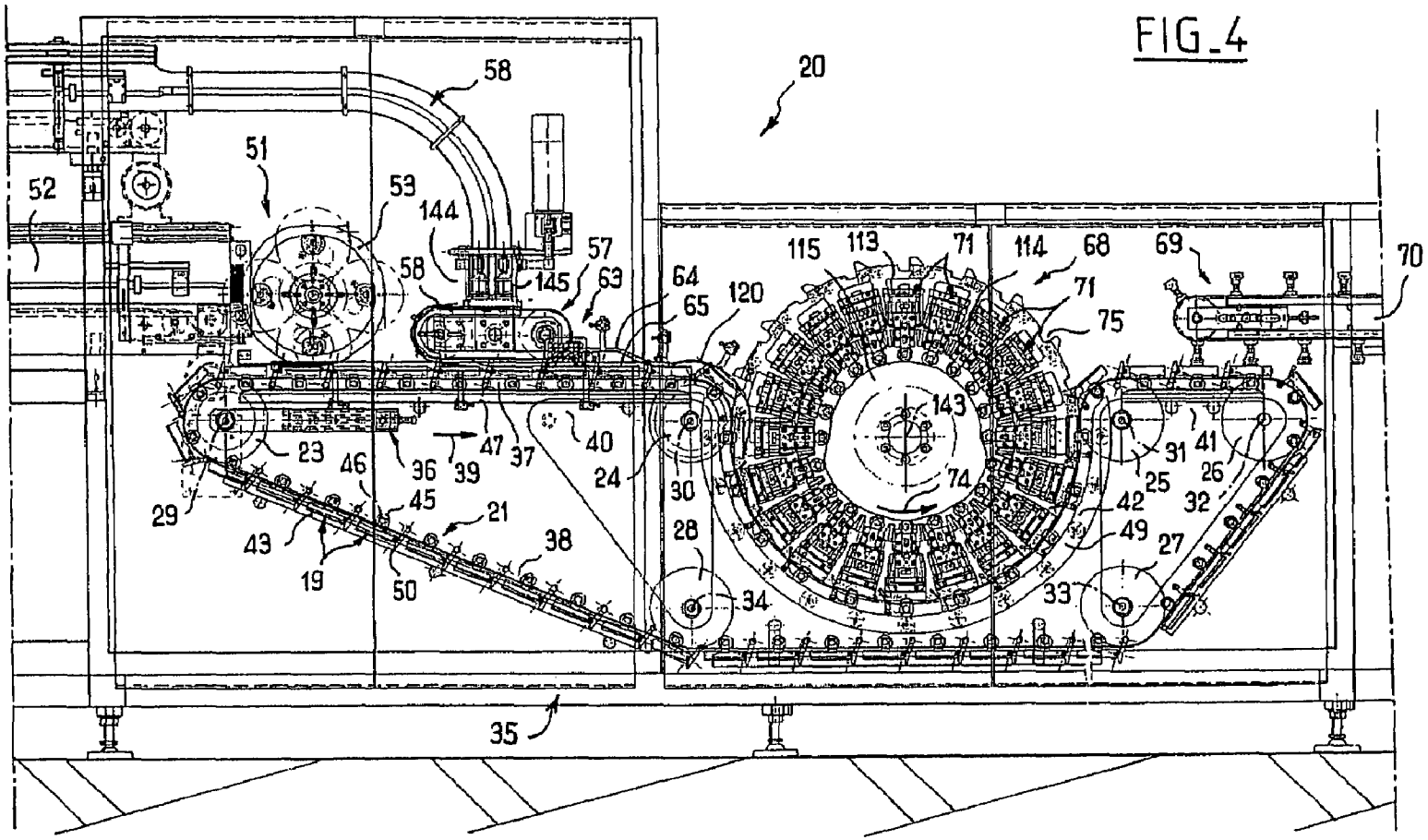
FIG. 4 shows a side elevation view of part of a packaging machine forming the machine according to the invention.
Figure 5:
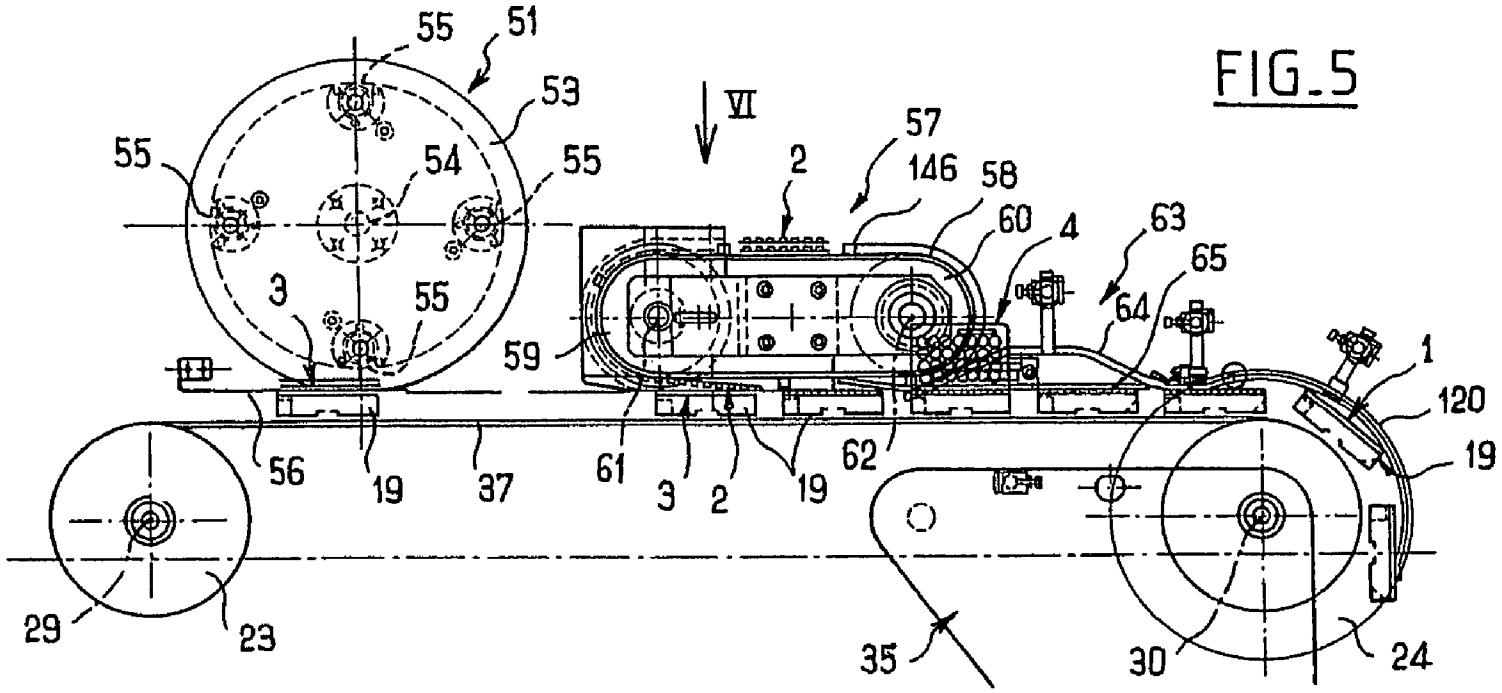
FIG. 5 shows in a side elevation view, and on a larger scale, the parts of this machine which are intended more particularly for carrying out step a of the method.
Figure 6:
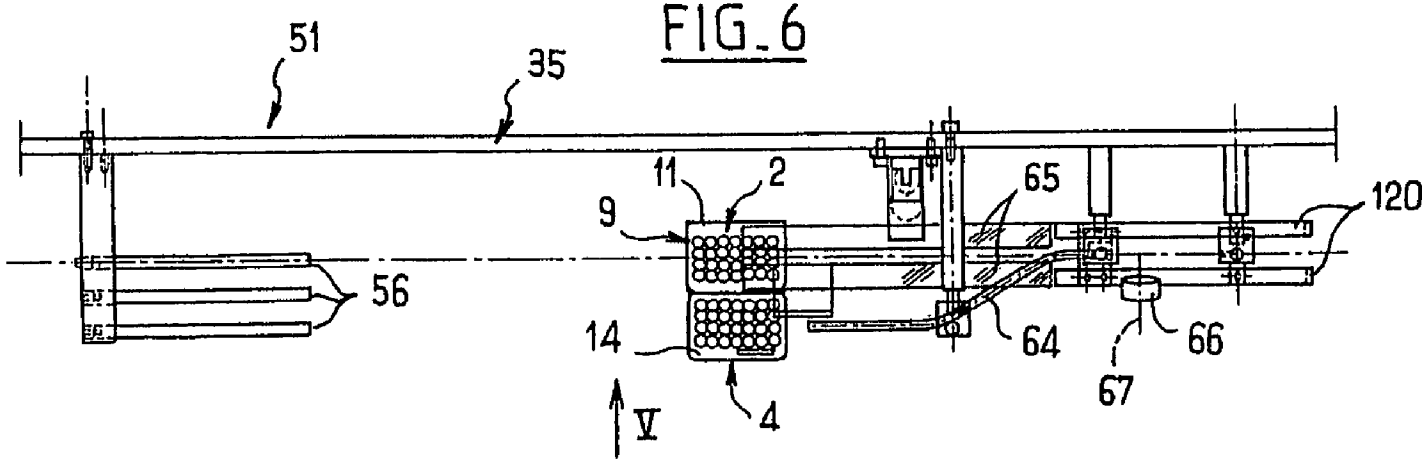
FIG. 6 shows a top view of some details of this part in a direction marked by VI in FIG. 5, the viewing direction of FIG. 5 being marked by an arrow V in FIG. 6.

For this purpose, as shown in FIG. 4, this machine 20 comprises an endless conveyor 21 comprising two endless belts or two chains 22 mutually juxtaposed in a horizontal direction, not designated, and guided by pairs of grooved wheels or of gearwheels mutually juxtaposed in this direction and mounted rotatably about a respective axis of each pair, said axis being oriented in this direction, to be precise, in the example illustrated, two wheels 23 of the same axis 29 which are supported by a stand 35 of the machine, by means of a known device 36 for tensioning the belts or chains 22, two wheels 24 mounted rotatably about the same axis 30, two wheels 25 mounted rotatably about the same axis 31, two wheels 26 mounted rotatably about the same axis 32, two wheels 27 mounted rotatably about the same axis 33 and two wheels 28 mounted rotatably about the same axis 34, the axes 30 to 34 being fixed with respect to the stand 35 of the machine, and the rotation of the wheels 23 to 28 about the respective axis with respect to this stand 35 being a free rotation.

The axes 29 to 32 are located at the same level, and the pairs of corresponding wheels define for the conveyor 21 an upper strand 37 active for carrying out the method according to the invention, while the axes 33 and 34 are located at a lower level and the corresponding wheels ensure simply the closing of the circuit of the conveyor 21 in the form of a lower strand 38 which is itself devoid of an active part in carrying out the method according to the invention.

More specifically, with reference to a defined direction 39 of coverage of the closed circuit of the belts or chains 22, the wheels 23, 24, 25, 26, 27, 28 succeed one another in this order, and the wheels 23 and 24 define a horizontal upstream portion 40 of the upper strand 37, that is to say of the corresponding path of the counterelectrodes 19, while the wheels 25 and 26 define a downstream horizontal portion 41 of this upper strand 37 and of this path, at a level identical to that of the portion 40. Between the pair of wheels 24 and the pair of wheels 25, the upper strand 37 and said path have a concave curved portion 42 in the form of an arc of a circle, with an axis 43 parallel to the axes 30 and 31, the strand 37 being guided at this level by means which will be described later. As a nonlimiting example, the axis 143 has been illustrated at a level slightly lower than that of the axes 30 and 31, with the result that the portion 42 has, with reference to the axis 143, an angular length slightly greater than 180°, but other choices could be made, without departing from the scope of the present invention, especially as a function of the value which it is appropriate to give the developed length of the portion 42, bearing in mind the speed of displacement of the conveyor 21 in the direction 39, the time necessary for ensuring thermoadhesion under conditions which will be described in detail later, and rates to be adhered to in order to integrate the machine 20 into a packaging line.

The belts or chains 22 jointly carry a multiplicity of counterelectrodes 19 which succeed one another in the direction 39 and connect to one another the two belts or chains 22 which ensure their transport along the closed circuit of the conveyor 21, at the same time maintaining a uniform spacing between them.

Each counterelectrode 19 has the general form of a plate having a plane useful face 43 which, at the upstream 40 and downstream 41 portions of the upper strand 37 of the conveyor 21, is horizontal and faces upward, being arranged above the belts or chains 22.

Each useful face 43 has a form substantially complementary to that of the face 6 of the blister sheet 1, with plane dimensions which correspond to the largest dimensions, of the dimensions of the respective main faces of the blister sheet 2, of the linerboard 3 and of the contingent flap 4 of the latter, if these dimensions are different. In other words, in the example illustrated, said useful face is rectangular, its largest dimension being orientated in the direction 9, with reference to the upstream 40 and downstream 41 portions, and it is recessed with as many cells 44 as the face 6 has blisters 8, with a shaping and positioning of the cells 4 which are as closely as possible complementary to those of the blisters 8 on the face 6, so as to allow an interlocking effect which will be described later.

Approximately in its middle, with reference to the upstream 40 and downstream 41 portions and the direction 39, each counterelectrode 19 carries, projecting downward, lugs, not designated, for integral securing to the two belts or chains 22, and, opposite the latter, that is to say below the latter in the region of the upstream 40 and downstream 41 portions, and on either side of the pair of belts or chains 22, these lugs carry two rollers 45 mounted freely rotatably about an axis 46 parallel to the axes 29 to 34. In the region of the upstream 40 and downstream 41 portions, the rollers 45 of each counterelectrode 19 bear downward on a respective straight guide 47, 48, while, in the region of the curved portion 42, the rollers 46 arranged respectively on either side of the pair of belts or chains 22 engage into a respective guide rail 49 of a general shape in the form of an arc of a circle of axis 143, the two guide rails 49 having a U-shaped cross section open from one of these rails 49 toward the other, so as to receive the respectively corresponding rollers 45 and to retain them both in the centrifugal direction and in the centripetal direction, with reference to the axis 143, at the same time opposing minimum resistance to the travel of the rollers 46 over the portion 42. Upstream with reference to the direction 39, each counterelectrode 19 carries integrally a respective dog 50 which forms a projection with respect to its useful face 43, immediately upstream of the latter with reference to the direction 39 and laterally with reference to this direction 39, to be precise on the right of the useful face 43 with reference to this direction 39 in the example illustrated.

Thus designed, each counterelectrode 19 is successively used as a vehicle for carrying out a first step of the method according to the invention, in the region of the upstream portion 40, in a way which will be described in detail here more particularly with reference to FIGS. 3 to 6.

During this first phase, each useful face 43 of a counterelectrode 19 passes successively, in the direction 39, opposite three stations 51, 57, 63, the last of which may be omitted in the absence of flap 4 on the linerboards 3.

The station 51 is a station for the destacking of linerboards 3, with their flap 4 occupying its initial position, from a magazine 52, in which the linerboards 3 with their flap 4 are presented according to a vertical orientation, in a horizontal stack, so as to be offered successively, in the direction 39, to the destacking station 51. At this station 51, a wheel 53, which is mounted and driven in rotation in synchronism with the conveyor 21 about an axis 54 parallel to the axes 29 to 34 and located at a level higher than that of the strand 37 and is equipped peripherally with suction cups 55 according to a design known per se, successively picks up the linerboards 3, with their flap 4, which are presented downstream of the magazine 52 with reference to the direction 39, in order to deposit them one by one onto the useful face 43 of a respective counterelectrode 19, in a position which may be gathered from FIGS. 3, 5 and 6 and in which the face 12 of the linerboard 3 rests flat on the useful face 43 of the counterelectrode 19 and in which the holes 16 are placed in the register with the cells 44. In this position, the flap 4 forms a projection overhung laterally with respect to the useful face 43, that is to say, more specifically, on the right of the latter with reference to the direction 39, but a slideway 56, which is suitably carried by the stand 35 of the machine and forms an overhang in the direction 39 in the region of the station 51 and which bears in a localized way on the face 13 of the linerboard 3 and affords a localized bearing surface for the flap 4, prevents any tilting of the linerboard 3 and of the flap 4 with respect to the corresponding counterelectrode 19. The dog 50 of this counterelectrode 19, butting against the linerboard 3 and/or the flap 4 in the immediate vicinity of their mutual junction, causes the assembly formed by the linerboard 3 and by the flap 4 to accompany the counterelectrode 19 in its movement in the direction 39 toward the following station 57.

This station 57 is a station for the destacking of blister sheets 2 coming from a magazine 58 in the form of a vertical stack, in which the faces 6 and 11 are horizontal and in which the face 6 and the blisters 8 face upward. In the nonlimiting example illustrated, the station 57 comprises a destacker 144 of a known type, comprising four vertical endless screws 145 driven in synchronism with displacement of the conveyor 21 and causing the blister sheets 2 to descend one by one, at each revolution, in order to deposit them one by one between the dogs 146 of an endless conveyor 58 executing a closed circuit, in synchronism with the displacement of the conveyor 21, about two rolls 59 and 60 of respective axis 61, 62 parallel to the axes 29 to 34, above the upper strand 37 of the conveyor 21 in the region of the upstream portion 40 of the latter. The dogs 146 of the endless conveyor 58 are capable of picking up in succession each of the blister sheets 2 which is presented at the bottom of the stack of the magazine 58 and which is extracted from it by the destacker 144 in order, after having been overturned, to be deposited onto a respective linerboard 3 which itself rests on the useful face 43 of a counterelectrode 19. The destacking station 57 is set in such a way that, then, each blister 8 is engaged into a respective cell of the useful face 43 of the counterelectrode 19, at the same time passing right through the linerboard 3 via a respective hole 16, as a result of which, on leaving the station 57 by being displaced in the direction 39 in the region of the upstream portion 40, each counterelectrode 19 carries and drives, particularly by the interlocking effect of the blisters 8 in the cells 44 through the holes 16, both a linerboard 3 and a flap 4, whose position with respect to the counterelectrode 19 has not changed, and a blister sheet 2, the face 6 of which rests flat on the face 13 of the linerboard 3, but the face 11 of which faces upward, as does the face 14 of the flap 4 which is then still arranged laterally with respect to the blister sheet 2, still overhung with respect to the useful face 43 of the counterelectrode 19.

From that moment on, the interlocking of the blisters 8 through the holes 16 of the linerboard 3 in the cells 44 of the counterelectrode 19 ensures both the drive of the linerboard 3, with its flap 4, and of the blister sheet 2 by the counterelectrode 19, in addition to the action of the dog 50 for this purpose, and the maintaining of a relatively exact positioning, during the travel over the rest of the upstream portion 40, over the portion 42 and finally over the portion 41.

It will be seen that, instead of thus associating with each linerboard 3 a blister sheet 2 having plan forms and dimensions substantially identical to those of this linerboard and comprising blisters 8 in a number identical to that of the holes 16 of the linerboard 3 and holes 17 of the contingent flap 4, in relative positions identical to those of these holes 16 and 17, it would likewise be possible to associate with each linerboard 3 a respective group of a plurality of mutually juxtaposed blister sheets, the plan forms and dimensions of which would complete one another in order, considered as a whole, to correspond substantially to those of the linerboard 3, and of which the total number of blisters and their relative position would correspond to those of the holes 16 of the linerboard 3 and of the holes 17 of the contingent flap 4 which would thus be used to group the various blister sheets and to secure the various blister sheets of the group integrally to one another. For this purpose, a plurality of successive stations 57 could be provided along the upstream portion 40 of the path of the counterelectrodes 19, in order to deposit in succession, under the conditions which have just been described, the various component blister sheets of the same group onto a respective location of each linerboard 3 which itself rests on a respective counterelectrode 19, or else it will be possible to preserve a single station 57 by arranging it in such a way that it is capable, under the conditions which have just been described, of depositing simultaneously one item of the group on each linerboard 3 which itself rests on a respective counterelectrode 19.

The holes 16 and 17 could, of course, have any suitable form and any suitable relative position in each location for receiving a blister sheet of the group. With regard to the present invention, each group of blister sheets thus associated with the same linerboard 3 and with the same contingent flap 4 is subsequently treated as one and the same blister sheet 2, and the term "blister sheet 2" must therefore be understood as meaning both a single blister sheet 2 and such a group of blister sheets.

The station 63 is a station for turning down the flap 4, with its face 14, onto the face 11 of the blister sheet 2 by folding along the line 18 by means of guides 64 and 65, the implementation of which comes within the normal capabilities of a person skilled in the art and the first of which bear successively upward and downward on the face 15 of the flap 4, while the second maintain a downward pressure on the face 11 of the blister sheet 2 in order to maintain it in bearing contact on the face 43 of the counterelectrode 19 by means of the linerboard 3. Advantageously, this station 57 also comprises, immediately downstream of the guides 64 and 65, a roller 66 mounted freely rotatably about an axis 67 parallel to the axes 29 to 34, above the upstream portion 40 of the strand 37, in order to compress the fold formed between the flap 4 and the linerboard 3 by the folding line 18.

The assembly consisting of the counterelectrode 19, the linerboard 3 and the flap 4 thus mutually superposed, flat, then passes from the portion 40 to the portion 42, where thermoadhesion takes place between the blister sheet 2 and the linerboard 3, on the one hand, and the flap 4, on the other hand, by passage through a thermoadhesion station 68 which shall be described in more detail with reference to FIGS. 4 and 7 to 12. On each counterelectrode 19, a wallet 1 is thus formed, which subsequently arrives, still driven by the interlocking of the blisters 8 in the cells 44 through the holes 16 of the linerboard 3 and by the dog 50 of the counterelectrode 19, at the downstream portion 41, in the region of which is located a station 69 for picking up the wallets 1 thus formed, for example by means of a suction cup device 70 of the type known per se, before each counterelectrode 19 travels over the lower strand 38 of the conveyor 21 in order to return upstream of the portion 40 for the purpose of a new cycle for carrying out the method according to the invention.

According to the present invention, at the station 68, thermoadhesion is ensured while the counterelectrodes 19 continue to be displaced continuously, together with the respective linerboard 3, flap 4 and blister sheet 2, thus making it possible for the machine 20 according to the invention to be integrated into a continuous packaging line.

For this purpose, each counterelectrode 19 travelling along the curved portion 42 is associated with a respective electrode 71 which accompanies it in its displacement.

For this purpose, a plurality of electrodes 71 are carried, uniformly distributed angularly about the axis 143, by a wheel 60 mounted rotatably about the axis 143 with respect to the stand 35 of the machine and driven in rotation about this axis 143 by means of a, for example, electric, motor 73 simply indicated diagrammatically in FIG. 8, under conditions such that, below the axis 143, and facing the counterelectrodes 19 travelling over the portion 42, the electrodes 71 are displaced in an arc of a circle of axis 143 in the same direction 74 as the counterelectrodes 19 and at the same angular speed as the latter.

For this purpose, advantageously, the wheel 72 itself, driven by the motor 73, is used for driving the conveyor 21. For example, for this purpose, the wheel 72 has peripherally as many notches 75 open in the direction of movement away from the axis 143 as electrodes 71, said notches being uniformly distributed angularly about the axis 143 in the same way as the latter, but being offset laterally with respect to the latter, respectively on either side of these, in a direction parallel to the axis 143, and the lugs, not designated, for the connection between each counterelectrode 19 and its rollers 46 carry integrally, projecting toward the axis 143, a respective bar 76 parallel to the axes 29 to 34 and 143 and capable of meshing with a respective notch 75 when the counterelectrode 19 in question travels over the portion 42 of the path of the conveyor 21. For this purpose, the mutual angular spacing between notches 75 succeeding one another in the direction 74 with reference to the axis 143 is identical to the angular spacing between two bars 76, that is to say likewise between two counterelectrodes 19 which succeed one another in this same direction in the region of the portion 42. For this purpose, a suitable dimensioning of the components of the station 68 is within the normal competence of a person skilled in the art.

Thus, the rotation of the wheel 72 in the direction 74 brings successive pairs of notches 74 into engagement with successive bars 76 and coercively brings about a displacement of the conveyor 21 in perfect synchronism with the rotation of the wheel 72, so as to present a respective electrode 71 successively face to face with each counterelectrode 19.

The synchronization of the destackers 51 and 57 and of the conveyor 70 of the pick-up station 69 could have been ensured in the same way, but it is preferable to have electrical means for the synchronization of respective drive motors, not illustrated, with the motor 73 for driving the wheel 72 and the conveyor 21.

The association of each electrode 71 with the respectively corresponding electrode 19 must be accompanied by the application of a mutual bearing pressure, flat, between the main faces, which are thermoadhesive or are made thermoadhesive, of the blister sheet 2 of the linerboard 3 and of the flap 4 respectively, to be precise both and/or either of the faces 6 and 13 and both and/or either of the faces 11 and 14.

For this purpose, when the radial position of the useful faces 43 of the counterelectrodes 19 with reference to the axis 143 is kept fixed by the effect of the guidance of the rollers 45 in the curved guide rails 49, a mounting, elastically retractable in the direction of the axis 143, of the electrodes 71 on the wheel 72 is used, this mounting being capable, furthermore, of allowing a coercive centripetal retraction of the electrodes 71 located opposite the counterelectrodes 19 which correspond to the portion 42 in the event of a stoppage, accidental or not, of the motor 73 or, more generally, of the machine 20.

This mounting will now be described, more particularly with reference to FIGS. 7 to 12.

Figure 7:
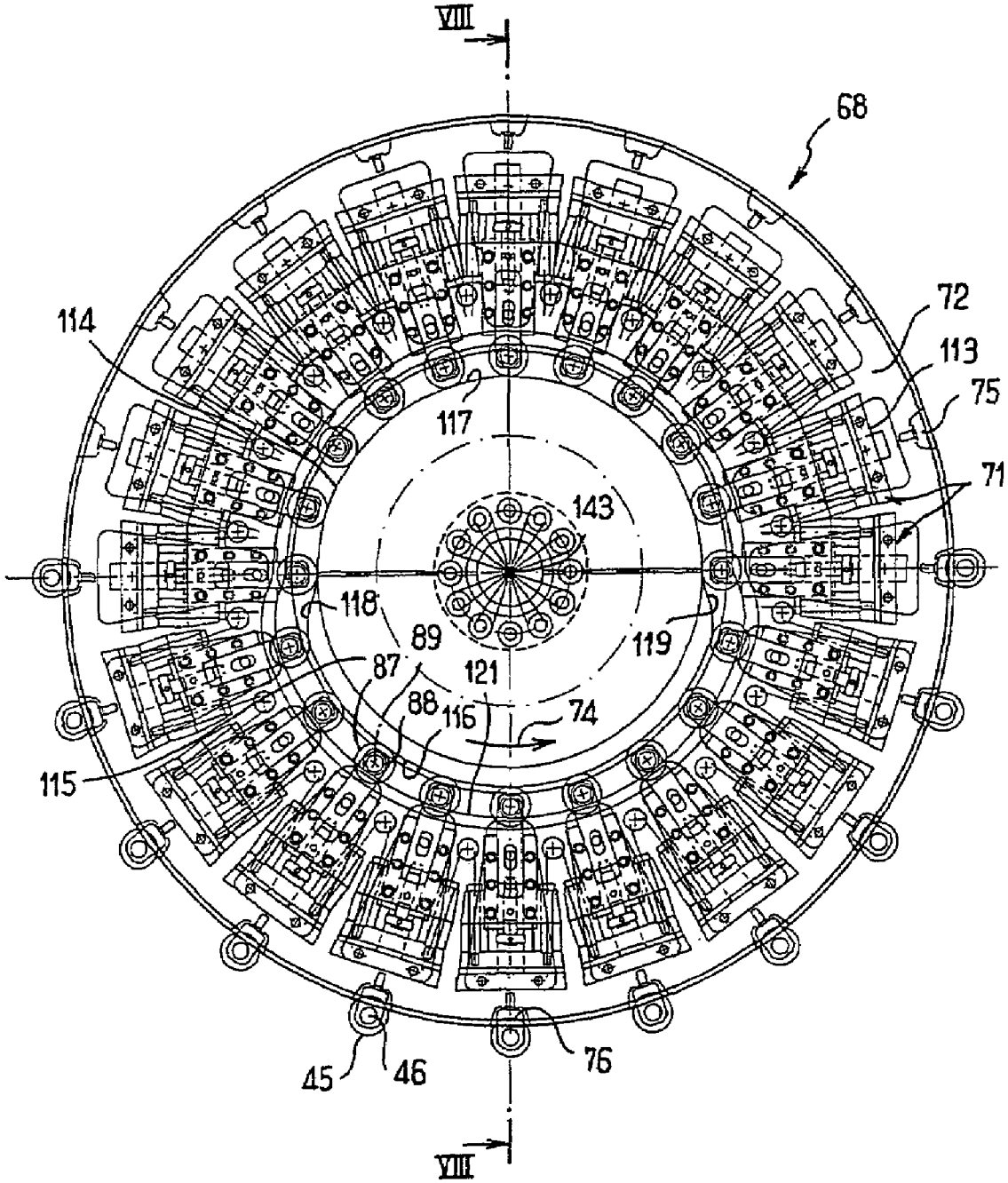
FIG. 7 shows, in an enlarged view and in side elevation, the parts of the machine which carry out steps b and c.
Figure 8:
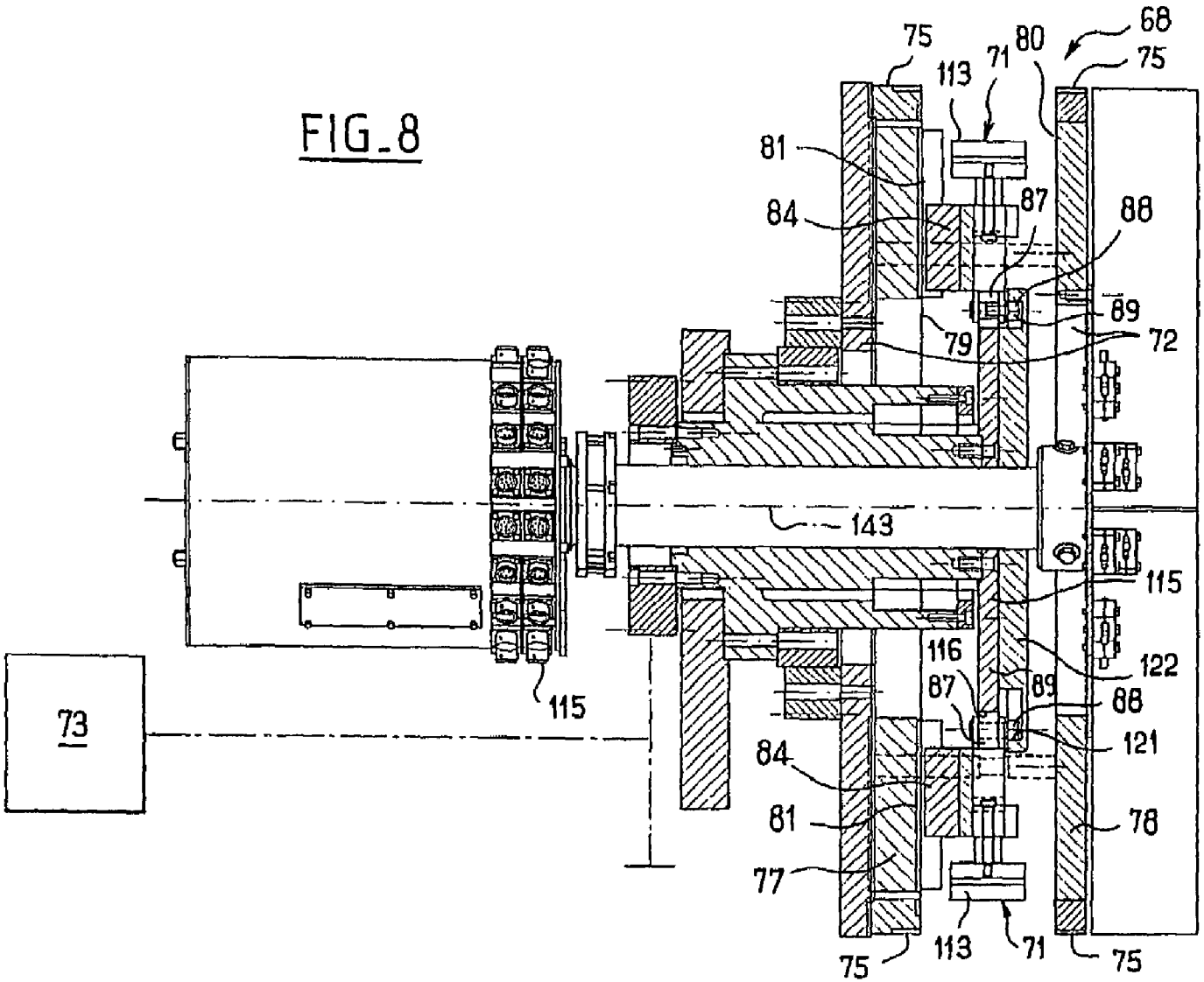
FIG. 8 shows a view of these parts of the machine partially in section in a plane marked by VIII-VIII in FIG. 7 and partially in elevation.

As shown more particularly in FIG. 8, the wheel 12 consists essentially of two disks 77, 78 of the same diameter and of the same axis 143, which have a respective edge face rotationally cylindrical about this axis and recessed with notches 75 which correspond to one another in pairs in a direction parallel to the axis 143, and the electrodes 71 are arranged between these two disks 77 and 78, the second of which has been omitted in FIGS. 4 and 7 in order to make it possible to illustrate the electrodes 71 and their mounting.

The two disks 77 and 78 have here, toward one another, a respective plane face 79, 80 perpendicular to the axis 143.

The various electrodes 71, 20 in number in the nonlimiting example illustrated, are mounted on that face 79 of the disk 77 which carries integrally as many slideways 81, radially with reference to the axis 143, as electrodes 71. Each of these slideways 81, arranged in relief on the face 79, has a mid-plane 82 including the axis 143 and common to a respective pair of notches 75 which correspond to one another in a direction parallel to this axis 143; the mid-planes 82 are thus uniformly distributed angularly about the axis 143 in the same way as the electrodes 71 and the pairs of notches 75.

Each slideway 81 itself carries, with the possibility of relative sliding in a respective direction 83 of the respective mid-plane 82, said direction 83 being perpendicular to the axis 143, a respective carriage 142 which itself forms a guide for sliding in the direction 83 for a respective slide 84. For this purpose, the carriage 142 carries integrally, but preferably adjustably in the direction 83, a yoke 85, on which the slide 84 is mounted slideably in the direction 83 and which has a free end zone 86 projecting from the slide 84 toward the axis 143. In this free end zone 86, the yoke 85 carries two rollers 87, 88 mounted rotatably on it about the same axis 89 parallel to the axis 143 and located in the plane 82, the first of these rollers having a mid-plane 90 parallel to the axis 143 and common to the slide 84 as a whole and to the corresponding electrode 71. The other roller 88 is offset toward the wheel 72 with respect to the slide 84.

The position of the slide 84 with respect to the yoke 85 in the direction 83 is fixed during the operation of the machine 20, but can be adjusted by means of a screw 91 of axis 92 coinciding with the intersection of the planes 90 and 82. This screw 91 has, toward the axis 143 and toward the yoke 85, an end 93 mounted freely rotatably about the axis 92 in the yoke 85, without any other possibility of relative displacement; said screw has, opposite its end 93, a head 94, on which action can be taken at will in order to rotate it in one direction or the other about the axis 92 with respect to the yoke 85 and to the slide 84, and it is engaged by means of a threaded portion 95, between its head 94 and its end 93, in a complementarily tapped coaxial hole 96 of the slide 94. A screw 97, engaged along an axis 98 perpendicular to the axis 92 into a complementarily tapped hole of the slide 98, makes it possible at will to immobilize the screw 91 in the selected position with respect to this slide 84.

In mutually symmetric positions with respect to the plane 82, the slide 84 is pierced, along axes 100 parallel to the axis 92 and located in the plane 90, with two passages 101 rotationally cylindrical about the respective axis 100, which pass right through said slide between a plane face 102 perpendicular to the axes 100 and facing toward the axis 143 and a plane face 103 likewise perpendicular to the axes 100, but facing in the direction of movement away from the axis 43. Each of the passages 101 has engaged in it, freely slideably along the respective axis 100, without any other possibility of relative displacement, an unthreaded portion 104 of a respective bolt 105 which, moreover, has a head 106 opposite the face 102 for bearing on the latter about the respective passage 101.

When each head 106 bears in this way on the face 102, each of the unthreaded portions 104 passes right through the slide 84 along the respective axis 100 and forms with respect to the face 103 of this slide a projection over an equal distance for the two bolts 105 which are identical to one another.

Opposite the head 106 along the respective axis 100, each of the bolts 105 has a threaded end portion 107 screwed coaxially into a rigid plate 108 equipped internally with a cooling fluid circuit, not illustrated, and itself serving as support to the respective electrode 71.

The plate 107 has a general orientation perpendicular to the axes 92 and 100 and, in particular, has, perpendicularly to these axes, two plane faces 109, 110, the first of which faces toward the axis 143 and toward the face 103 of the slide 84 and the second of which faces in the direction of movement away from the axis 143 and carries the electrode 71 integrally by means of a thermal insulation layer 111, in a position in which the electrode 71, fixed with respect to the support plate 108, has respectively toward the latter and opposite the latter a respective plane face 112, 113 perpendicular to the axes 92 and 100; the first of these faces 112 and 113 is placed in integral bearing contact on the face 110 by means of the thermal insulation layer 111, whereas the second is free, facing the direction of movement away from the axis 143 and forms a useful face of the electrode 71.

Between the faces 109 and 103 is interposed, respectively around each unthreaded portion 104 of a bolt 105, a spring which consists here of a coaxial sleeve 114 of an elastically compressible material, the two sleeves 114 being identical to one another in their geometry and their composition.

Each electrode 71 incorporates heating means, for example in the form of at least one inductor in the case of thermoadhesion by induction or in the form of at least one electric heating resistor associated with temperature control means and placed in thermal conduction relation with the useful face 113 of the electrode 71 through the mass of the latter. Thus, in the nonlimiting example illustrated, the electrode 71 houses two electrical heating resistors 150 which extend along its useful face 113 and are associated with a thermocouple 151.

The heating means incorporated in the electrode 71 and the cooling circuit incorporated in the plate 108 are connected respectively to electricity supply means and to means for the circulation of a cooling fluid by means of rotary joints of axis 143, of which FIG. 8 illustrates only the rotary joint 115 for connecting the electrodes 71 to electricity supply means.

Each of the faces 113 is plane and has a contour substantially identical to that of the useful face 43 of a counterelectrode, in such a way that, during the rotation of the wheel 72 in the direction 74 about the axis 143 with respect to the stand 35 of the machine and during the synchronized displacement of the conveyor 21, each useful face 113 of an electrode 71 comes progressively into place opposite the useful face 43 of a counterelectrode 19 carrying the wallet 1 already shaped, but not having undergone thermoadhesion, at the transition between the portions 40 and 42, then remains placed opposite this useful face 43 during the entire travel over the portion 42, at the same time applying to the wallet 1 heating and pressure capable of bringing about thermoadhesion, and then moves apart from the face 43 of the counterelectrode 19 and from the wallet 1 which has thus undergone thermoadhesion, at the transition between the portion 42 and the portion 41 travelled over by the wallets 1 which have undergone thermoadhesion.

The travel time over the path portion 42 determines the application time of the pressure and heating, but, by action on the speed of displacement of the electrodes in the direction 74 and of the counterelectrodes in the direction 39, on the number of electrodes 71 and on the developed length of the portion 42, on which depends the number of matched electrodes and counterelectrodes for applying pressure and heating to a wallet to undergo thermoadhesion, it is possible to ensure the rate of the machine 20 is adapted to the rates of machines which may be located upstream and downstream in a packaging line, as a person skilled in the art will easily understand.

Preferably, the face 113 of each electrode 71 has forms and dimensions directly complementarily to those of the useful face 43 of a counterelectrode 19, considered without its cells 44, in such a way that, when the counterelectrodes 19 cross the portion 42, the useful face 113 of a respective electrode 71 is superposed exactly on the face 43 of a respective counterelectrode 19 by means of the shaped wallet 1 which is undergoing thermoadhesion.

As will easily be understood by a person skilled in the art, by virtue of the mounting which has just been described, each electrode 71 occupies at rest, that is to say in the absence of any stress, a defined position with respect to the slide 84, in which defined position the sleeves 114, if appropriate subjected to the same compression prestress along the respective axis 100, maintain a maximum mutual spacing between the faces 119 and 103. With respect to this initial position, however, the electrode 71 may be retracted elastically in the direction of an approach with respect to the slide 82 at the expense of an elastic compression of the sleeves 114 along their axis 100, the sleeves 114 tending, however, to return the electrode 71 into its initial position with respect to the slide 84. This effect is utilized in order to apply to the wallet 1, during thermoadhesion, the mutual application pressure of the faces, laid against one another, of the various components of this wallet 1 during the crossing of the portion 42 by the counterelectrodes 19.

For this purpose, the roller 87 is intended to afford a bearing surface for the assembly consisting of the yoke 85 and of the slide 84 in a centripetal direction with respect to the wheel 92, at the same time cooperating, for this purpose, with a cam track 114 on which it bears toward the axis 143.

The cam track 114 consists of an edge face, facing the direction of movement away from the axis 143, of a flat cam 115 perpendicular to the axis 143 and adjustable between two defined limiting orientations about the axis 143 with respect to the stand 35 of the machine, to be precise an operating orientation, in which it is illustrated in FIGS. 4, 7, 8, 11 and 12 and with reference to which it will now be described, and a safety orientation, in which it is rotated through 180° with respect to this operating orientation about the axis 143 in a way which is not illustrated, but will become apparent from the rest of the description. The change from the operating orientation to the safety orientation may be made by voluntary control by an operator and, advantageously, automatically in the event of a voluntary or accidental stoppage of the motor 73; the change from the safety orientation to the operating orientation preferably takes place solely by control and on the condition that the motor 73 is restarted under the normal conditions of use of the machine 20.

The cam track 114 comprises, with regard to this possibility of orientation of the cam 115, two portions 116 and 117 rotationally cylindrical about the axis 143, with a respective angular development of the order of 180°, these portions 116 and 117 being connected to one another by means of two transition portions 118, 119 having an angular development of the order of a few degrees and designed so as not to form an obstacle to their being crossed by a roller 87.

In the operating orientation of the cam 115, the portion 116 of larger diameter faces downward, that is to say toward the curved path portion 42 of the counterelectrodes 19, whereas the portion 117 of smaller diameter faces upward.

Thus, during the rotation of the wheel 72 in the direction 74 with respect to the stand 35 of the machine, each roller 87 travels successively over the portion 117 of the cam track 114, this corresponding to an inactive position of the corresponding electrodes 71, then arrives in the transition zone 118, at that time facing toward the upstream portion 40 of the path of the conveyor 21, while the useful face 113 of the corresponding electrode arrives opposite the useful face 43 of a counterelectrode carrying a wallet 1 in the folded state, but not having undergone thermoadhesion, advantageously retained on the useful face 43 of the counterelectrode 19 by a curved extension 120 of the guides or slideways 65, coaxially surrounding the circular path of the useful faces 43 of the counterelectrodes 19 at the crossing of the wheels 24, that is to say at the transition between the upstream portion 40 and the curved portion 42, in order then to come to bear on the face 15 of the flap 4, until, during the continuation of the joint movement of the electrodes 71 and counterelectrodes 19, the face 113 of the electrode 71 itself applies such pressure.

Figure 12:
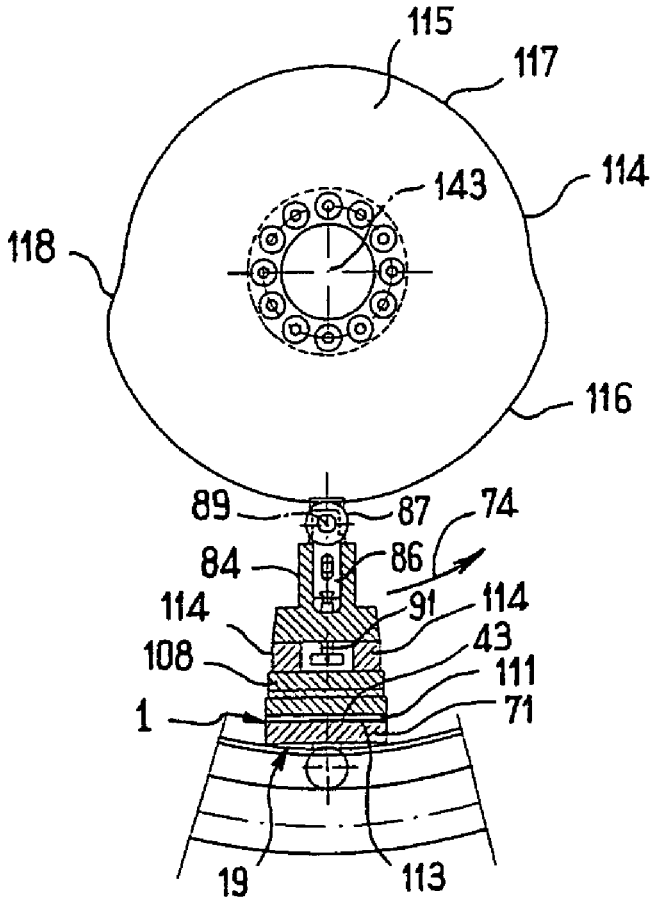

Subsequently, the roller 87, moving progressively away from the axis 143 at the crossing of the transition portion 118, thus likewise moving the slide 84 and the electrode 71 away from the axis 143, comes into contact with the portion 116 of the cam track 114 and remains in contact with this portion 116 during the whole of the common circular path of the electrodes 71 and of the counterelectrodes 19. During the whole crossing of the portion 116 of the cam track 114, the yoke 85 remains at the same distance from the axis 143, but, by a suitable adjustment of the screw 91, making it possible to adjust the position of the slide 84 and, with it, of the useful face 113 of the electrode 71 with respect to the yoke 85 in the absence of stress on the electrode 71, the result is such that, by being applied with its face 113 to the wallet 1, itself applied to the face 43 of the counterelectrode 19, the electrode 71 is forced to retract elastically, that is to say by the elastic compression of the sleeves 114, toward the slide 84 and toward the axis 143 over a predetermined stroke which governs the reaction which the sleeves 114 oppose elastically to this retraction and, consequently, the pressure with which the face 113 bears on the face 43 by means of the wallet 1 during thermoadhesion. FIG. 12 illustrates this relative positioning for maintaining the wallet 1, during thermoadhesion, in a state of elastic compression between the faces 113 and 44 of the electrode 71 and of the counterelectrode 19.

Consequently, when the electrode 71 and the counterelectrode corresponding to it arrive in the immediate vicinity of the wheels 25 which define the transition between the portion 42 and the portion 41 of the path of the counterelectrodes 19, the roller 87 crosses the transition portion 119 of the cam track 114 and allows a retraction of the assembly consisting of the yoke 95, of the slide 84 and of the electrode 71 toward the axis 143 as far as a relative position which corresponds to the crossing of the portion 117 of the cam track 114 by the roller 87.

This retraction is advantageously implemented by means of another cam track 121 of suitable shaping, defined by a second cam 122, illustrated only in FIG. 8 for the sake of clarity, which cam 122 is flat, perpendicular to the axis 143 and integrally fastened, flat, to the cam 115 and by means of its cam track 121 affords a bearing surface for the rollers 88 in the direction of movement away from the axis 143. The cam track 121 is homothetic to the cam track 114 with reference to the axis 143, in order to retain each roller 87 permanently in bearing contact on the cam track 114, and therefore does not need to be described any further.

In the safety orientation, not illustrated, of the cam 115 and, with it, of the cam 122, the portion 117 of the cam track 114 faces downward, that is to say faces the curved path portion 42 of the counterelectrodes 19, and, by means of the rollers 88 associated with the corresponding electrodes 71, the cam track 121 applies a coercive withdrawal movement toward the axis 143 in order to interrupt the contact between the useful face 113 of the electrodes 71 in question and the wallet 1 resting on the useful faces 43 of the corresponding counterelectrodes 19, in order to prevent excessive heating of these wallets 1 which are subsequently preferably eliminated, although the return of the cams 115 and 112 to their operating orientation, at the restarting of the motor 73 if the passage of the cams 115 and 122 to their safety position was brought about by a momentary stoppage of said motor, in some cases makes it possible to terminate thermoadhesion under good conditions.

There could possibly be the fear that, instead of following the counterelectrodes 19 at the transition between the portion 42 and the portion 41, by remaining engaged by means of the blisters 8 in the cells 44 of the useful face 43 of these counterelectrodes 19, the wallets 1 which have undergone thermoadhesion tend to follow the rotational movement of the electrodes 71.

To prevent this, each electrode 71 advantageously has associated with it at least one ejection pusher which, if necessary, detaches from the useful face 113 of the electrode 71 a wallet 1 which would tend to stick to it.

In the example illustrated, each electrode 71 has associated with it two pushers 123, each of which is in the form of a straight rod with a respective axis 124 parallel to the axis 92 and which are located respectively on either side of the midplane 90 and slightly in front of the plane 82 with reference to the direction 74.

Figure 10:
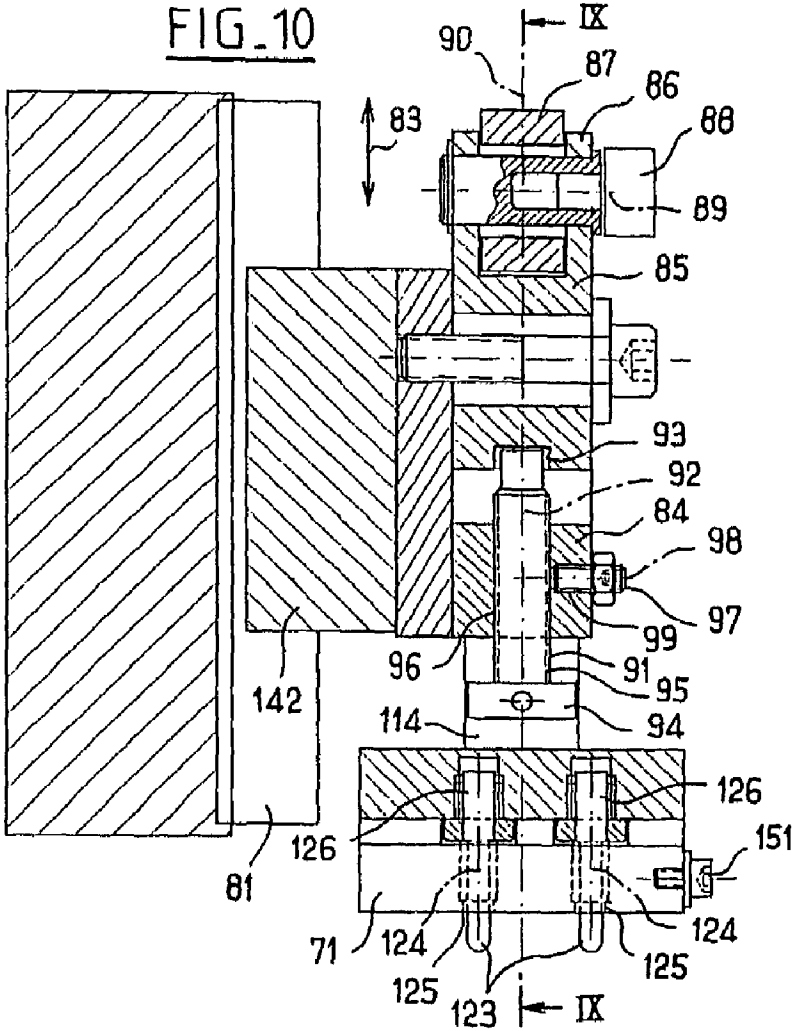
FIG. 10 shows the same details partially in a view in the direction marked by X in FIG. 9 and partially in section in another mid-plane marked by X-X in this FIG. 9.
Figure 9:
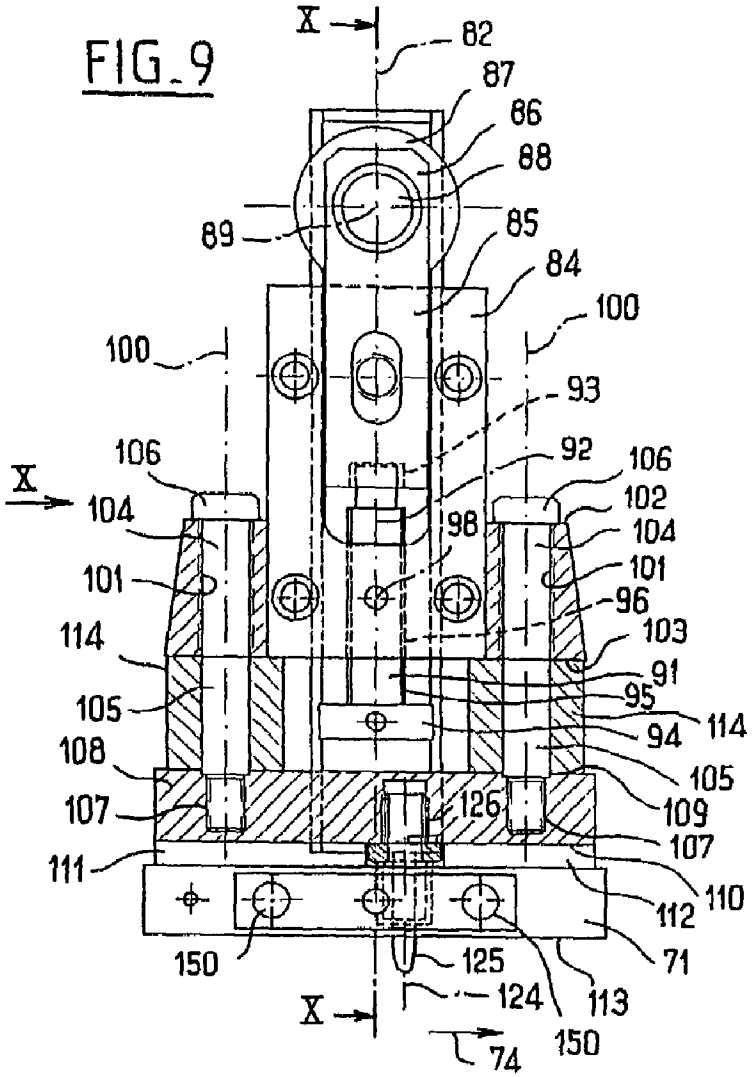
FIG. 9 illustrates the details of an electrode and of its mounting in a view corresponding to that of FIGS. 4 to 7, but further enlarged, partially in section in a mid-plane marked by IX-IX in FIG. 10.
Figure 11:
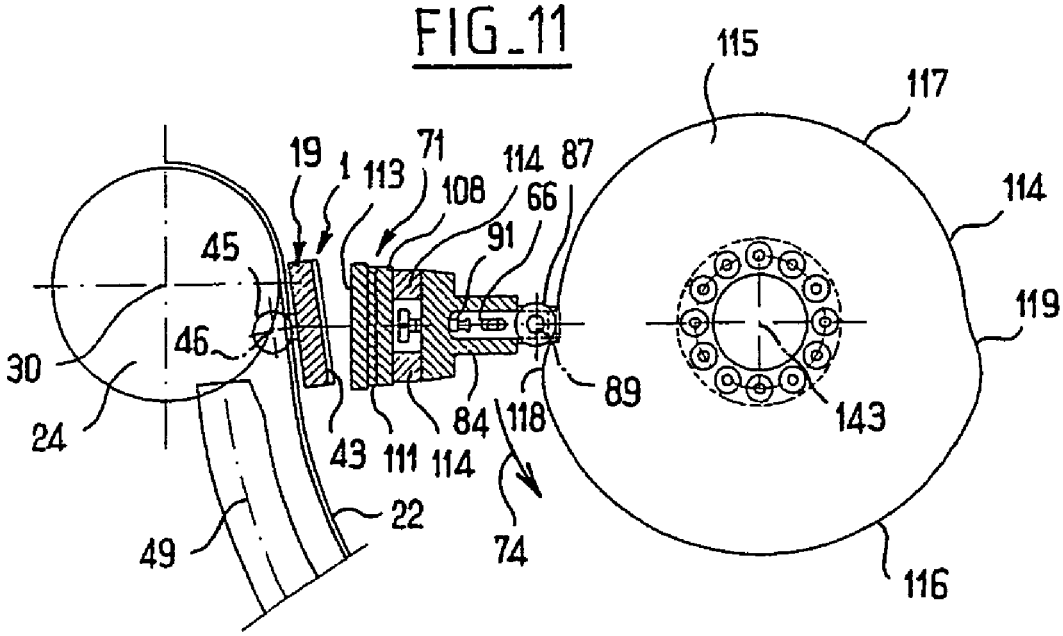
FIGS. 11 and 12 show, in views similar to those of FIGS. 4, 7 and 9, but on an intermediate scale between those of FIGS. 7 and 9, the cooperation between an electrode and a counterelectrode at two moments in the execution of their common path.

Each of these pushers 123 passes coaxially, without contact, through the electrode 71 via a coaxial hole 125 of the latter, in order to prevent a heating of the pushers 123, and is mounted elastically retractably toward the axis 143 in a respective bush 126 screwed into the support plate 108, from a position illustrated in FIGS. 9 and 10, in which each ejection pusher 123 forms a projection on the face 113 and which each pusher 123 occupies as soon as stress is applied to it in the direction of retraction with respect to the face 113, especially when the electrode 71 is applied with this face 113 to a wallet 1, itself in bearing contact on the useful face 43 of a counterelectrode 19. As soon as this bearing contact ceases, however, each pusher 123 tends elastically to resume its position projecting with respect to the face 113 and thereby detaches from the latter the wallet 1 which would possibly tend to remain stuck there.

A person skilled in the art will easily understand that the embodiment of the invention which has just been described, both in terms of the method and in terms of the machine, is only one nonlimiting example, with regard to which numerous variants can be provided, without thereby departing from the scope of this invention.

In particular, a person skilled in the art will easily adapt this embodiment to the situation of linerboards 3 having no flap 4 and/or to the situation of blister sheets 2 comprising a single blister 8, the number of cells 44 then being limited to a unit, as are the number of holes 16 of the linerboard 3 and the number of holes 17 of the contingent flap 4.

A person skilled in the art will also easily adapt this embodiment to the situation of linerboards 3 equipped with a plurality of flaps other than the flap 4, which are articulated on the linerboard 3 directly or by means of the contingent flap 4 and are intended to remain freely articulated, in the state not turned down; during passage through the thermoadhesion station 68, in order subsequently to be turned down onto the linerboard 3 or the flap 4, if appropriate at the same time containing a booklet, a notice or a promotional article, and fastened in the turned-down position, in particular in a repositionable way, to the linerboard 3 or the flap 4 or else to one another. In such a case, guide means, the design of which is within the normal capabilities of this person skilled in the art, will be provided for retaining these other flaps against inopportune turning down during passage through the successive stations 51, 57, 63, 68 and, if appropriate, 69.

Likewise, a person skilled in the art will easily understand that, by adaptions coming within his normal capabilities, the method and machine according to the invention may be applied to the assembling together with a linerboard not only of a blister sheet, as defined above, in a commonly accepted sense of this term, but also other types of packaging of one or more doses of a product, for example fluidic product, or of one or more individual articles, to be precise, for example, to the assembling together with linerboards of pouches or sachets for the packaging of a sample of cosmetic products, of food products or of upkeep products. Consequently, within the meaning of the present invention, the term "blister sheet" will be understood as meaning any type of packaging of one or more doses of a fluid or solid product or of one or more individual articles, whether this packaging is flexible or semirigid or rigid, provided that this packaging lends itself to a presentation in the state assembled together with a linerboard, in particular in the form of a wallet, as described above. Moreover, within the meaning of the present invention, the term "blister" will be understood as meaning any localized overthickness which the blister sheet, within the meaning of the present invention, can have, in particular in relation to the presence of its contents, in a prefabricated way or not. When it is not possible or is not desirable to utilize the penetration of one or more blisters of the blister sheet, within the meaning of the present invention, in one or more cells of a counterelectrode through one or more holes of the linerboard, in order to ensure an exact relative positioning, a joint drive and a protection of the blister sheet and of its contents against compression between the electrode and the counterelectrode, under the conditions described, use can be made, for all or part of these various effects, of a punctiform adhesion of the blister sheet to the linerboard during its depositing onto the latter at the destacking station of the blister sheets and/or of the production of a sidewalk around the location of the blister sheet on the linerboard, by the folding of suitable flaps of the latter, either between the destacking station for the linerboards and the destacking station for the blister sheets or between the destacking station for the blister sheets and the thermoadhesion station, by suitable means for the machine which are known per se to a person skilled in the art, and it is possible to ensure the drive of the linerboards and then that of the linerboards together with the blister sheets by means of dogs similar to the dogs 50 and carried by the counterelectrodes likewise serving in this case, preferably, as vehicles during the entire application of the method according to the invention.

Furthermore, it goes without saying that a machine according to the invention may be equipped with means for detecting any malfunctioning of the various components of these successive stations, in particular in terms of the presence and of the correct positioning of the linerboards 3, with their contingent flaps 4 and/or their other contingent flaps, and of the blister sheets 2, and with means for detecting and ejecting the wallets 1 which are faulty for one reason or another. The selection and implementation of such means are within the normal capabilities of a person skilled in the art.

The invention claimed is:

1. A method of assembly between:

a blister sheet having two plane main faces and comprising at least one product containment blister projecting on a first of said main faces, and a linerboard having two plane main faces and having at least one hole for the passage of said blister, the blister sheet and the linerboard being capable of occupying a defined relative position, in which a first of said main faces of the linerboard is laid against the first main face of the blister sheet, around the blister, and at least one of the first main faces being thermoadhesive or being made thermoadhesive, said method comprising:

a) placing the blister sheet and the linerboard in said defined relative position, b) applying to the blister sheet and to the linerboard, which occupy said defined relative position, a pressure for the mutual clamping of their first main faces and a treatment capable of making adhesive said first main face which is thermoadhesive or is made thermoadhesive, for the time necessary for bringing about a mutual thermoadhesion of said first main faces, c) causing the application of said pressure and said treatment to cease, wherein steps b and c are carried out by causing a succession of individualized blister sheets and of linerboards, placed in said defined relative position during step a, to travel jointly and continuously, said step a itself being carried out continuously, wherein step b is carried out by a means selected from the group comprising induction and thermal conduction, wherein a plurality of electrodes and a plurality of counterelectrodes are circulated continuously in a respective closed circuit, said closed circuits comprising a common limited portion, along which the electrodes and counterelectrodes follow a common path, at the same time being matched in a defined relative position in which they offer a respective plane face toward one another, between an entrance, at which the electrodes and counterelectrodes approach one another, at the same time circulating along said respective closed circuit, and an exit, at which the electrodes and counterelectrodes move apart from one another, at the same time circulating along said respective closed circuit, and wherein step b is carried out by introducing a blister sheet and a linerboard, placed in their said defined relative position during step a, between a mutually corresponding electrode and counterelectrode at the entrance of said common path, and by causing the blister sheet and the linerboard, placed in their said defined relative position, to execute said common path between said mutually corresponding electrode and counterelectrode, as far as the exit, at which the mutual spacing apart of said mutually corresponding electrode and counterelectrode carries out step c.

2. Method as claimed in claim 1, the linerboard comprising a flap having a first main face initially placed in the extension of the first main face of the linerboard and, in said defined relative position, occupying a turned-down position in which its said first main face is laid against the second of said main faces of the blister sheet, and at least the first main face of the flap or the second main face of the blister sheet being thermoadhesive or being made thermoadhesive, wherein the flap is placed in said turned-down position, during step a, after the first main faces of the linerboard and of the blister sheet have been laid against one another, and wherein step b is carried out when the flap occupies said turned-down position, in such a way that said mutual clamping pressure likewise forms a pressure for the mutual clamping of the first main face of the flap and of the second main face of the blister sheet, and in such a way that said treatment likewise makes adhesive said main face of these main faces which is thermoadhesive or is made thermoadhesive, said time being selected in such a way that it is sufficient likewise in order to bring about a mutual thermoadhesion of the first main face of the flap and of the second main face of the blister sheet.

3. The method as claimed in claim 1, wherein the blister sheets and the linerboards are caused to travel along a curved path during step b.

4. The method as claimed in claim 1, wherein one of said plane faces has at least one cell for receiving a blister, and in that step b is carried out so as to engage the blister in said cell.

5. The method as claimed in claim 1, wherein the counterelectrodes are caused to execute, upstream of said common path, an upstream path along which their said face faces upward, and in that they are used, along this upstream path, as vehicles for a respective blister sheet and respective linerboard during the carrying out of step a.

6. The method as claimed in claim 5 wherein the counterelectrodes are produced or selected in such a way that they have respectively a cell, and in that step a is carried out by successively depositing, flat, the linerboard with the second of its said main faces on said face of a counterelectrode, said hole being placed in register with said cell, and the blister sheet with its first main face on the first main face of the linerboard, said blister being engaged in said hole and, through the latter, in said cell, then, if appropriate, with a contingent flap of the linerboard being folded in order to bring it from its initial position into its turned-down position.

7. The method as claimed in claim 1, wherein the counterelectrodes are caused to execute, downstream of said common path, a downstream path along which their said face faces upward, and in that they are used, along this downstream path, as vehicles for a respective mutually assembled blister sheet and a respective linerboard.

8. The method as claimed in claim 1, wherein the closed circuit of the electrodes is circular, and in that the closed circuit of the counterelectrodes is in the form of an arc of a circle coaxial to the closed circuit of the electrodes along said common path.

9. The method as claimed in claim 2, wherein the blister sheets and the linerboards are caused to travel along a curved path during step b.

10. The method as claimed in claim 4, wherein the counterelectrodes are caused to execute, upstream of said common path, an upstream path along which their said face faces upward, and in that they are used, along this upstream path, as vehicles for a respective blister sheet and respective linerboard during the carrying out of step a.

11. The method as claimed in claim 10 wherein the counterelectrodes are produced or selected in such a way that they have respectively said cell, and in that step a is carried out by successively depositing, flat, the linerboard with the second of its said main faces on said face of a counterelectrode, said hole being placed in register with said cell, and the blister sheet with its first main face on the first main face of the linerboard, said blister being engaged in said hole and, through the latter, in said cell, then, if appropriate, with the contingent flap of the linerboard being folded in order to bring it from its initial position into its turned-down position.

12. The method as claimed in claim 4, wherein the counterelectrodes are caused to execute, downstream of said common path, a downstream path along which their said face faces upward, and in that they are used, along this downstream path, as vehicles for a respective mutually assembled blister sheet and a respective linerboard.

13. The method as claimed in claim 5, wherein the counterelectrodes are caused to execute, downstream of said common path, a downstream path along which their said face faces upward, and in that they are used, along this downstream path, as vehicles for a respective mutually assembled blister sheet and a respective linerboard.

14. The method as claimed in claim 6, wherein the counterelectrodes are caused to execute, downstream of said common path, a downstream path along which their said face faces upward, and in that they are used, along this downstream path, as vehicles for a respective mutually assembled blister sheet and a respective linerboard.

15. The method as claimed in claim 10, wherein the counterelectrodes are caused to execute, downstream of said common path, a downstream path along which their said face faces upward, and in that they are used, along this downstream path, as vehicles for a respective mutually assembled blister sheet and a respective linerboard.

16. The method as claimed in claim 11, wherein the counterelectrodes are caused to execute, downstream of said common path, a downstream path along which their said face faces upward, and in that they are used, along this downstream path, as vehicles for a respective mutually assembled blister sheet and a respective linerboard.

17. The method as claimed in claim 4, wherein the closed circuit of the electrodes is circular, and in that the closed circuit of the counterelectrodes is in the form of an arc of a circle coaxial to the closed circuit of the electrodes along said common path.

18. The method as claimed in claim 5, wherein the closed circuit of the electrodes is circular, and in that the closed circuit of the counterelectrodes is in the form of an arc of a circle coaxial to the closed circuit of the electrodes along said common path.

19. The method as claimed in claim 6, wherein the closed circuit of the electrodes is circular, and in that the closed circuit of the counterelectrodes is in the form of an arc of a circle coaxial to the closed circuit of the electrodes along said common path.

20. The method as claimed in claim 7, wherein the closed circuit of the electrodes is circular, and in that the closed circuit of the counterelectrodes is in the form of an arc of a circle coaxial to the closed circuit of the electrodes along said common path.

21. The method as claimed in claim 10, wherein the closed circuit of the electrodes is circular, and in that the closed circuit of the counterelectrodes is in the form of an arc of a circle coaxial to the closed circuit of the electrodes along said common path.

22. The method as claimed in claim 11, wherein the closed circuit of the electrodes is circular, and in that the closed circuit of the counterelectrodes is in the form of an arc of a circle coaxial to the closed circuit of the electrodes along said common path.

23. The method as claimed in claim 12, wherein the closed circuit of the electrodes is circular, and in that the closed circuit of the counterelectrodes is in the form of an arc of a circle coaxial to the closed circuit of the electrodes along said common path.

24. The method as claimed in claim 13, wherein the closed circuit of the electrodes is circular, and in that the closed circuit of the counterelectrodes is in the form of an arc of a circle coaxial to the closed circuit of the electrodes along said common path.

25. The method as claimed in claim 14, wherein the closed circuit of the electrodes is circular, and in that the closed circuit of the counterelectrodes is in the form of an arc of a circle coaxial to the closed circuit of the electrodes along said common path.

26. The method as claimed in claim 15, wherein the closed circuit of the electrodes is circular, and in that the closed circuit of the counterelectrodes is in the form of an arc of a circle coaxial to the closed circuit of the electrodes along said common path.

27. The method as claimed in claim 16, wherein the closed circuit of the electrodes is circular, and in that the closed circuit of the counterelectrodes is in the form of an arc of a circle coaxial to the closed circuit of the electrodes along said common path.

* * * * *